United States Patent [19]

Goldfarb et al.

[11] 4,171,806

[45] Oct. 23, 1979

[54] PLAY APPARATUS

[76] Inventors: Adolph E. Goldfarb, 4614 Monarca Dr., Tarzana, Calif. 91356; Erwin Benkoe, deceased, late of Encino, Calif., by Elisabeth Benkoe, executrix, 17965 Medley Dr., Encino, Calif. 91316

[21] Appl. No.: 869,928

[22] Filed: Jan. 16, 1978

[51] Int. Cl.[2] ..... A63F 9/00

[52] U.S. Cl. ..... 273/1 R

[58] Field of Search ..... 273/1 R, 1 E, 1 M, 1 L; 46/44, 87, 88

[56] References Cited

U.S. PATENT DOCUMENTS

| | | | |
|---|---|---|---|
| 661,541 | 11/1900 | Lathrop | 46/88 X |
| 2,991,589 | 7/1961 | Ayala | 46/44 X |
| 3,046,694 | 7/1962 | Holderer | 46/44 X |
| 3,795,400 | 3/1974 | Glass et al. | 273/1 R |
| 3,903,865 | 9/1975 | Kaneko | 46/44 X |
| 3,949,984 | 4/1976 | Navara | 46/88 X |
| 3,997,157 | 12/1976 | Meyer | 273/1 R |

*Primary Examiner*—Paul E. Shapiro

*Attorney, Agent, or Firm*—Robert M. Ashen; Robert J. Schaap

[57] ABSTRACT

A play apparatus for producing a simulated explosion or other sudden action. The apparatus has a plurality of pieces that are releasably assembled together to form an interior chamber. An expandable bag such as a balloon is disposed in the chamber and connected to a manually operable pump. The pieces are connected together in such a manner that they resist the outward push of the expanding balloon against them until there is sufficient expansion of the balloon to release the pieces from one another and permit the balloon to thrust the pieces outwardly in a sudden action. The apparatus may be incorporated in the play of a game where players take turns pumping more air into the balloon. The release of air from the expanded balloon may be used also, as for example, to create a suitable sound effect.

15 Claims, 5 Drawing Figures

PLAY APPARATUS

The present invention contemplates a play apparatus where players may take turns selectively blowing up an inflatable bag, such as a balloon, that is contained within a multiple piece enclosure. The inflated bag pushes outwardly against the enclosure until, when it is inflated a sufficient amount, it operates means which release the pieces of the enclosure from one another and the pieces are thrust outwardly by the bag to create a sudden and exciting effect such as an "explosion" or the "blowing" of an oil well.

Such a play device is not known in the prior art. There have been play devices which inflated balloons and the like until they burst. There also have been play devices which progressively impinged upon an inflated balloon (as by adding more weights to a pin pushed against the inflated balloon) until the balloon was caused to burst. There also have been various prior art play devices which operated on a time delay principal, as for example, a play device that was tossed back and forth between the players, the device including a wind-up noisemaker which operated to make a noise at the end of a predetermined time period. The players attempted to avoid being the player holding the device when the period ended and the noisemaker operated.

As noted above, in the play device of the present invention, the inflatable bag does not burst in the course of its use but causes the release and outward thrust of related pieces to create a bursting or exploding effect without actually destroying the bag. Such sudden action adds fun and excitment to the play of various games which may incorporate the device. The device may utilize a simple hand operated air pump and be relative inexpensive for a device providing such an action feature.

Further, the inflatable bag need not be replaced as it does not itself burst. Further, the subsequent release of air from the inflated bag after the "explosion" can be utilized, as for example by producing a desired sound.

IN THE DRAWINGS

Reference is now made to the accompanying drawings in which.

Figure 1:
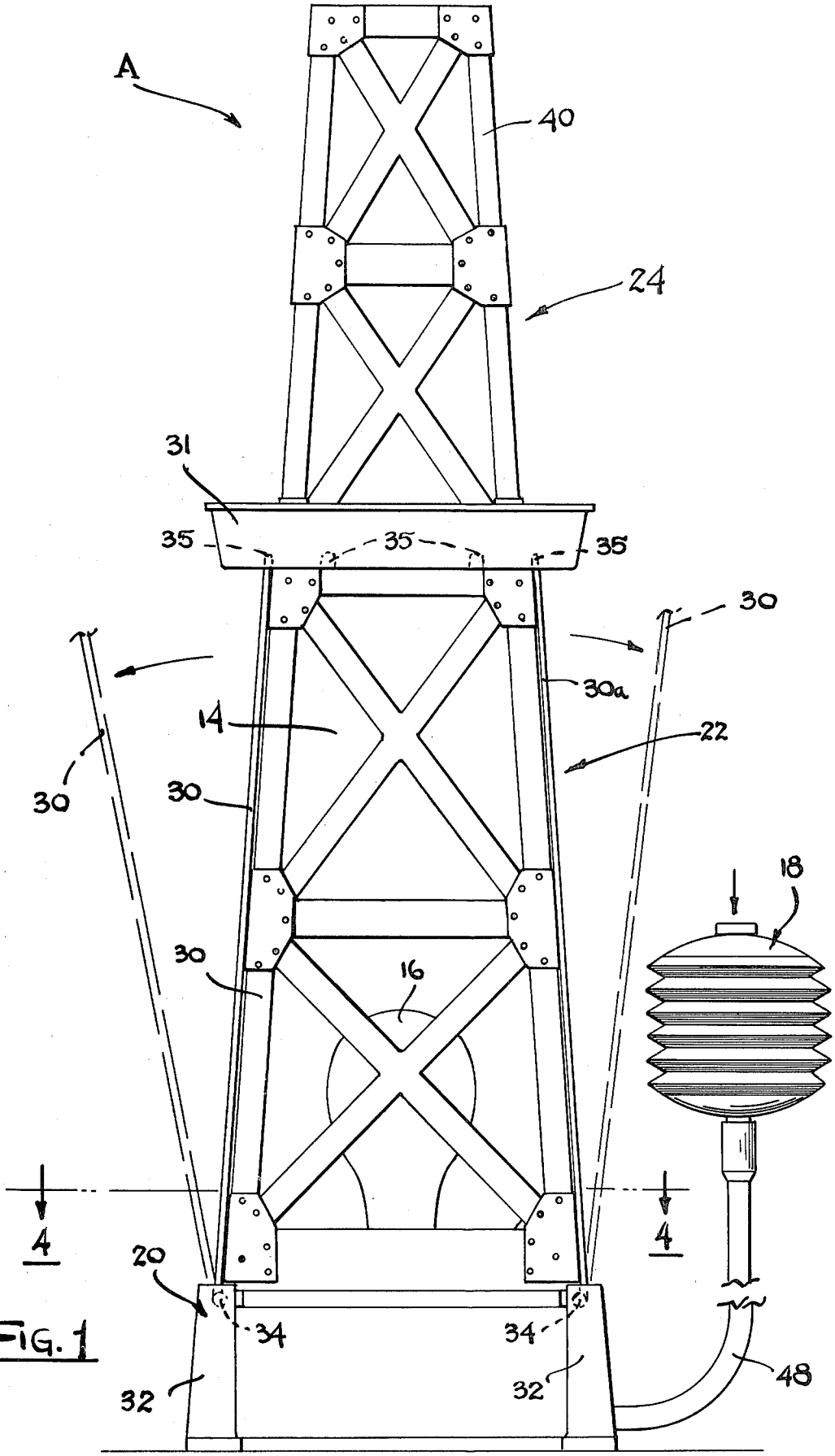
FIG. 1 is a side elevational view of a play apparatus in the form of a toy "bursting" oil rig, this apparatus being a presently preferred embodiment of the present invention.

In general, the illustrated presently preferred form of the invention comprises a play apparats A for providing a sudden simulated "exploding" or "bursting" action effect. The play apparatus A includes a plurality of pieces that are releasably assembly together to form a simulated oil rig having an interior chamber 14. An expandable bag in the form of a balloon 16 is disposed in the chamber 14 and connected to a manually operable pump 18. As the players operate the pump to expand the balloon outwardly against the walls of the chamber, the interconnection of the pieces limit the outward movement of such pieces until there is sufficient expansion of the balloon to release the pieces from one another and to permit the balloon to thrust the pieces outwardly in a sudden action simulating the "blowing" of an oil well. Subsequent release of air from the expanded balloon may be used as for example to create a suitable sound effect.

In its illustrated form, the play apparatus A includes a frame or base means 20, a lower oil rig section 22 pivotally mounted on the frame means, and an upper oil rig section 24 releasably interconnected with the lower section 22. In the illustrated play apparatus, a housing 23 on the frame forms a chamber 25 which receives air under pressure to expand a balloon 16. The balloon 16 expands until it effects an upward shift of the oil upper rig section 24. This, in turn, releases the pieces, e.g. four rectangularly located side wall sections or pieces 30, making up the lower section 22 so that they will be thrust outwardly by the outward pressure of the expanded balloon.

Now considering the illustrated play apparatus in further detail, the illustrated base 20 comprises a generally rectangular horizontal platform or wall 29 which supports the housing 23 and which is supported on four depending legs 32. The legs may rest on a supporting surface, such as a floor or a table. The four side wall sections 30 of the lower oil rig section 22 are pivotally mounted on the base 20 as noted above. More particularly, the lower section 22 comprises the four generally like side wall sections 30 which are each trapezoidal in shape and hingedly connected by a first pivot 34, along its lower edge to one of the edges of the base wall 29. Each illustrated side wall section 30 is comprised of peripherally extending edge portions and a plurality of lattice-like inner portions extending across the section so as to simulate the appearance of a oil rig. The lower side wall sections 30 are shown in their assembled positions in FIG. 1, and are illustrated in "burst" or expanded positions in FIG. 4 wherein their upper ends have swung outwardly around their pivoted lower ends.

Figure 3:
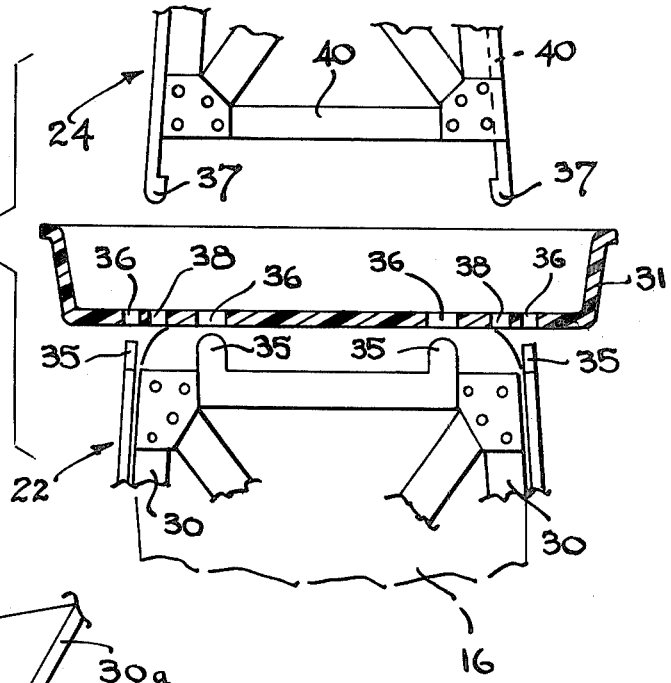
FIG. 3 is an exploded fragmentary side elevation view, partially in section, of an intermediate portion of the toy oil rig showing the release of the upper section of the rig from the lower section of the rig.

As best shown in FIG. 3, a tray 31 representative of a work platform or so-called "fourble board" is disposed between the upper rig section 24 and the lower rig section 22. Moreover, the upper rig section and the lower rig section are releasably attachable with respect to one another or the tray 31. For this purpose, each lower wall section 30 is provided at its upper end with a pair of spaced apart tabs 35 which extend into apertures 36 formed in the base wall of the tray. The upper rig section 24 is connected to the tray 31 by means of downwardly extending spaced apart tabs or pins 37 which extend into receiving apertures 38 on the base wall of the tray 31. The tabs 37 are formed with hook-like ends that are disposed within the apertures 38. However, it should be understood that other means of releasably interconnecting the upper and lower rig sections to each other or otherwise the tray 31 could be employed. In this same respect, the tray 31 could also be releasably connected to the upper rig section.

The upper rig section 24 presents four faces 40 which generally align with and provide a visual extension of the simulated oil well rig portrayed by the adjacent lower side wall section 30. Thus, the sides or faces 40 of the upper section 24 may present an open lattice or framework similar to that of the lower section as described below. The upper section need not have separate pieces as in the case of the lower section 22, but may be a single piece simulating the appearance of the upper portion of an oil drilling rig. When the apparatus is assembled as shown in FIG. 1, the tabs 35 are received in the apertures 36 and thereby hold the lower section walls 30 in position against the outward push of the expanding balloon 16.

The various components forming part of the apparatus of the present invention and particularly the upper section 24, the lower section 22 and the frame 20 can be formed of a number of known plastic materials, as for example, polyethylene, polystyrene, polybutadiene, various vinylidene copolymers and the like, and which may be formed in a number of known plastic molding operations, as for example, blow-molding, thermoforming, injection molding or the like. In addition, for purposes of increased strength and durability, many of the components could be formed of reinforced plastic materials including, for example, fiberglass, boron, carbon and other fibers and grown crystal whiskers incorporated in a suitable matrix, such as an epoxy resin or other thermo-plastic or thermo-setting resin. Notwithstanding, many of the components of the apparatus could be formed of other known structural materials, such as metals, wood or the like.

Figure 2:
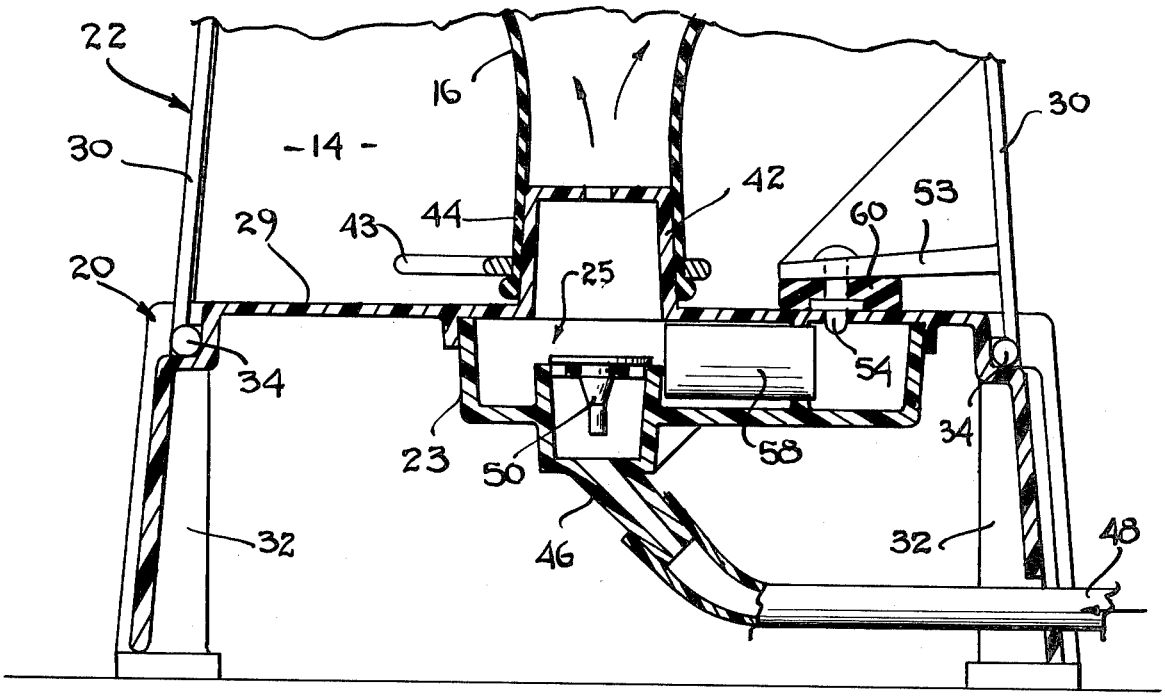
FIG. 2 is an enlarged vertical section of a portion of the play apparatus of FIG. 1.

As shown in FIGS. 1 and 2, the balloon 16 is disposed within the chamber or enclosure 14 formed by the lower section 22 and mounted on a tubular hub 42 extending upwardly from the base wall 29 at approximately its center and communicating with the plenum chamber 25. The end or nozzle 44 of the balloon 16 is disposed around the upper end of the hub 42 and maintained in a generally sealed manner by any conventional sealing means such as snap ring 43 so that air introduced into the balloon through the hub will cause expansion of the balloon. The generally rectangular box-like housing 23 is secured to the underside of the base wall 29 and defines the chamber 25. A fitting 46 is provided in the lower wall of the housing 25 as shown in FIG. 2. The fitting is connected to an air line 48 which extends to a pumping device, such as a bellows 18. However, another form of device which provides air or a similar gas under pressure, and preferably a manually operated pumping means, could be employed.

The fitting 46 includes a one-way valve 50 that permits one-way flow from the bellows 18 into the chamber 25 and then into the balloon 16. The valve 50 may be of any conventional construction such as one having a flexible flap which overlaps one or more apertures. Air flow from the bellows 18 pushes the flap away from the aperture to permit flow while air flow from the expanded balloon toward the belows pushes the flap against the aperture to limit flow.

Figure 4:
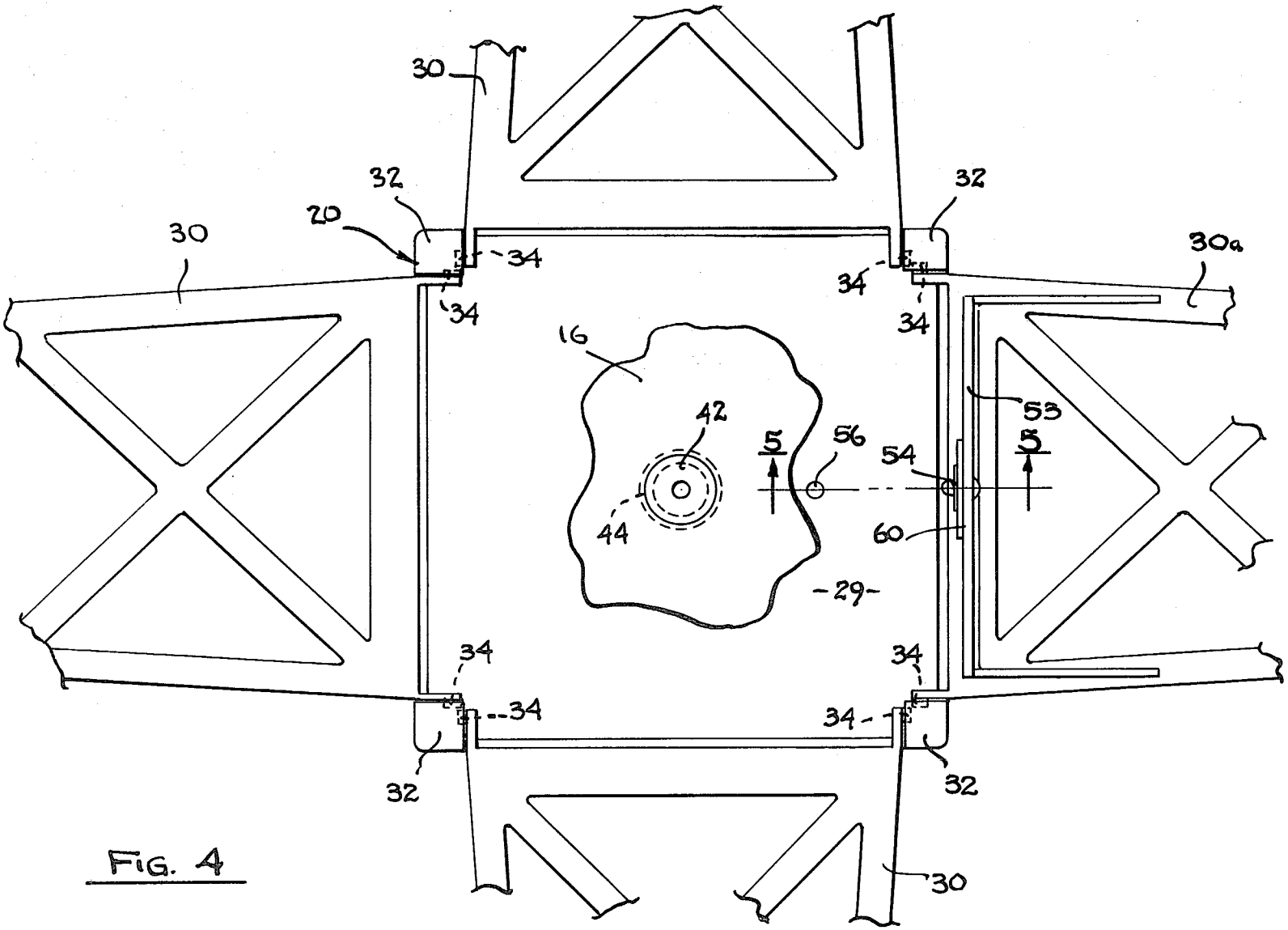
FIG. 4 is a top plan view partially broken away of a lower portion of the toy rig, illustrating outwardly thrust positions for pieces of the lower section of the rig and taken along the plane of line 4—4 of FIG. 1.

As the balloon 16 is expanded by repeated pumping of the bellows 18, it will eventually reach an expanded condition as shown in FIG. 3. In addition and as shown in that FIG. 3, the expanding balloon 16 engages the tray 31 and tends to push the tray 31 and upper rig section 24 upwardly until the tabs 35 are disengaged from the mating grooves 36. When this happens, the upper rig section 24 topples from the remaining rig structure and the pieces or wall sections 30 of the lower rig section 22 are released so they may be suddenly thrust outwardly under the outward force of the expanded balloon. The lower side wall sections 30 thus pivot in the outward direction as illustrated in FIG. 4. A simulated oil well "blow" is thus created.

Figure 5:
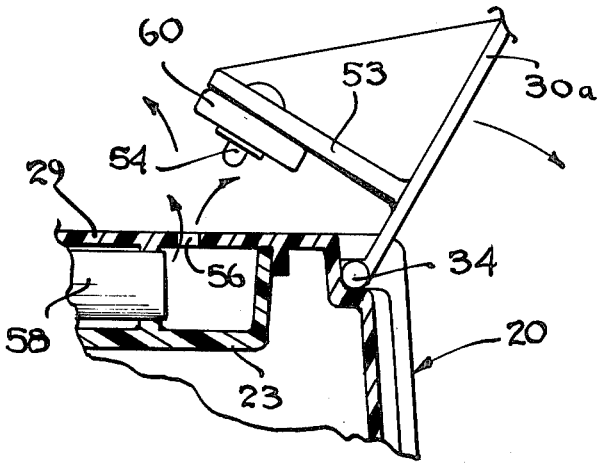
FIG. 5 is a fragmentary view of a relief valve in the open position taken along line 5—5 of FIG. 4.

The pressurized air contained in the expanded balloon 16 may be utilized to provide an additional effect. In the illustrated apparatus A, as shown best in FIG. 5, one of the lower wall sections **30*a* includes a tab portion 53 which carries a depending finger 54. This finger 54 is received, when the structure is in its assembled position, in a small hole 56 through the base wall 29. The hole 56 leads into the chamber 25. When the lower wall sections 30 pivot outwardly, the finger 54 is withdrawn from the hole 56 and air is permitted to be expelled from the expanded balloon 16 through the chamber 25 and out through the hole 56. A flexible resilient washer 60 is disposed about the pin 54 to engage the base plate 29 and serve as a sealing element. This flow of air may be utilize, as for example, to create a suitable sound effect which might be associated with the "blowing" of an oil well. A sound-maker 58 is provided in the chamber 25** to provide a somewhat whinning or whirring sound which might be associated with the blowing of an oil well. Such a sound-maker may be of conventional construction being operated by the passage or flow of air past or through it.

When the play apparatus A is reassembled by pivoting the lower wall sections 30 inwardly and positioning the upper rig section 22 atop the lower rig wall sections with the tray 31 therebetween, the pins 36 on the lower section 22 are received in the apertures 36 on the tray 31. The finger 54 will also be reinserted in the hole 56 to again close the chamber 25. It will be noted that air from the expanded balloon 16 did not return through the air line 48 to the bellows 18 because of the one-way valve 50.

The illustrated play apparatus A may be used in connection with the play of a game. For example, the players may alternate turns pumping the bellows. When the oil well blows, the player who caused such blow may either gain or lose in the play of the game from such action. It would also be possible for the action of the oil well structure to affect the subsequent play of the players in the game such as by awarding a certain amount of money to the successful driller for use in play of the remainder of the game. The illustrated play apparatus provides suspense and excitment to the players in anticipation of the coming blow or explosion and the blow itself is an exciting visual and auditory effect.

The illustrated play apparatus may take other forms as for example a bomb exploding, a cage bursting to permit the release of the occupant, a toy erupting volcanic mountain and the like.

Thus, there has been illustrated and described a unique and novel play apparatus which permits pieces of a structure to be thrust outwardly by the thrust of an inflated bag and which therefore fulfills the objects and advantages sought therefor. It should be understood that many changes, modifications, variations and other uses and applications of the play apparatus will become apparent to those skilled in the art after considering this specification and the accompanying drawings. Therefore, any and all such changes, modifications, variations and other uses and applications which do not depart from the nature and spirit of the invention are deemed to be covered by the invention which is limited only by the following claims.

In the claims:

1. Play apparatus for producing a sudden action comprising:

(a) a plurality of pieces releasably assembled together to define an enclosure that defines a chamber,
(b) a flexible, expandable bag disposed in said chamber,
(c) pump means connected to said bag for selectively introducing fluid into said bag to cause it to expand, and
(d) control means operatively associated with said assembled pieces and operable to limit movement of said pieces in response to the outward push of the expanding bag until there is sufficient expansion of the bag to release said pieces and permit the bag to propel the pieces outwardly in a sudden action.

2. The play apparatus of claim 1 wherein said control means comprises holding means for releasably holding the pieces in said assembled condition against the outward force of the bag from the interior of the chamber, and release means operatively associated with said holding means and said bag to cause said holding means to release said assembled pieces from one another when there has been sufficient expansion of the bag, thereby allowing the bag to thrust the pieces outwardly in the sudden action.

3. The apparatus of claim 1 wherein a noise producing device actuated by air flow is provided in the path of air being expelled from the expanded bag.

4. The play apparatus of claim 2 wherein said holding means comprises a structural section disposed generally adjacent to said pieces and engagable therewith to limit said outward movement of said pieces and wherein said release means comprises a structural section disposed in direct communication with the chamber so that expansion of the bag will move the release section and thereby move the holding section out of engagement with the enclosure pieces.

5. The play apparatus of claim 1 wherein said pump means comprise an elongated fluid line connected at one end to said bag and a manually operable pump device connected to the other end of said fluid line.

6. The play apparatus of claim 5 wherein said pump device comprises a compressible air chamber.

7. The play apparatus of claim 6 wherein said air chamber is a flexible, resilient bellows.

8. The play apparatus of claim 1 further including means associated with said bag for permitting the release of pressurized air from the expanded bag when the pieces are thrust outwardly.

9. The play apparatus of claim 8 wherein said bag is in communication with a compartment and means are provided between the movable pieces and the compartment so that the compartment is closed when the pieces are in assembled closure forming position and the compartment automatically opens when the pieces are thrust outwardly.

10. Play apparatus for producing a sudden "explosive" action comprising:
(a) a frame for being disposed on a supporting surface,
(b) a plurality of enclosure pieces pivotally mounted on said frame and when releasably assembled in closed positions defining an enclosure that forms an interior chamber,
(c) latch means for releasably holding said pieces in said assembled closed positions against outward force from the interior of the chamber,
(d) an expandable, flexible bag disposed in said chamber,
(e) manually operable air pump means connected to said bag for selectively introducing air into said bag to cause it to expand, and
(f) release means operatively associated with said latch means to cause said latch means to release said assembled pieces from one another when there has been sufficient expansion of the bag to thereby permit the bag to thrust the pieces outwardly in a sudden action.

11. The play apparatus of claim 10 wherein said latch means comprises a structural section disposed generally above said hinged pieces and engagable therewith to limit the outward movement of said pieces and wherein said release means comprises a structural piece disposed across the top of the chamber and associated with the latch means so the expansion of the bag will lift the release means and thereby lift the latch means out of engagement with the enclosure pieces.

12. The play apparatus of claim 11 wherein said apparatus simulates the appearance of an oil well drilling rig with said pieces simulating the lower section of such a rig and the latch means simulates the appearance of an upper section of such a rig.

13. The play apparatus of claim 10 further including means associated with said bag for permitting the release of pressurized air from the expanded bag when the pieces are thrust outwardly.

14. The play apparatus of claim 13 wherein said bag is in communication with a compartment and means are provided between the movable pieces and the compartment so that the compartment tion and the compartment opens when the pieces are thrust outwardly.

15. The apparatus of claim 13 wherein a noise producing device actuated by air flow is provided in the path of air being expelled from the expanded bag.

* * * * *